US011241718B2

(12) United States Patent
Jonathan et al.

(10) Patent No.: US 11,241,718 B2
(45) Date of Patent: Feb. 8, 2022

(54) CLEANING COMPONENTS AND METHODS IN A PLATING SYSTEM

(71) Applicant: Applied Materials, Inc., Santa Clara, CA (US)

(72) Inventors: Joseph Antony Jonathan, Kalispell, MT (US); Kyle M. Hanson, Kalispell, MT (US); Jason A. Rye, Kalispell, MT (US); James E. Brown, Kalispell, MT (US); Gregory J. Wilson, Kalispell, MT (US); Eric J. Bergman, Kalispell, MT (US); Tricia A. Youngbull, Kalispell, MT (US); Timothy G. Stolt, Kalispell, MT (US)

(73) Assignee: Applied Materials, Inc., Santa Clara, CA (US)

( * ) Notice: Subject to any disclaimer, the term of this patent is extended or adjusted under 35 U.S.C. 154(b) by 376 days.

(21) Appl. No.: 16/386,646

(22) Filed: Apr. 17, 2019

(65) Prior Publication Data

US 2019/0321861 A1 Oct. 24, 2019

Related U.S. Application Data

(60) Provisional application No. 62/660,440, filed on Apr. 20, 2018.

(51) Int. Cl.

| | |
|---|---|
| ***C25D 21/08*** | (2006.01) |
| ***B08B 1/00*** | (2006.01) |
| ***C25D 17/00*** | (2006.01) |

(52) U.S. Cl.

CPC ..... *B08B 1/003* (2013.01); *C25D 17/004* (2013.01); *C25D 21/08* (2013.01)

(58) Field of Classification Search

None

See application file for complete search history.

(56) References Cited

U.S. PATENT DOCUMENTS

2002/0096191 A1 7/2002 Lofaro et al.
2006/0058730 A1 3/2006 Pratt et al.

(Continued)

FOREIGN PATENT DOCUMENTS

WO 2014120775 A1 8/2014

OTHER PUBLICATIONS

International Preliminary Report on Patentability dated Oct. 20, 2020 in International Patent Application No. PCT/US2019/027980, 5 pages.

(Continued)

*Primary Examiner* — Stefanie S Wittenberg

(74) *Attorney, Agent, or Firm* — Kilpatrick Townsend & Stockton LLP

(57) ABSTRACT

Systems for cleaning electroplating system components may include a seal cleaning assembly incorporated with an electroplating system. The seal cleaning assembly may include an arm pivotable between a first position and a second position. The arm may be rotatable about a central axis of the arm. The seal cleaning assembly may include a cleaning head coupled with a distal portion of the arm. The cleaning head may include a bracket having a faceplate coupled with the arm, and a housing extending from the faceplate. The housing may define one or more arcuate channels extending through the housing to a front surface of the bracket. The cleaning head may also include a rotatable cartridge extending from the housing of the bracket. The cartridge may include a mount cylinder defining one or more apertures configured to deliver a cleaning solution to a pad coupled about the mount cylinder.

14 Claims, 6 Drawing Sheets

(56) References Cited

U.S. PATENT DOCUMENTS

| | | | | |
|---|---|---|---|---|
| 2007/0107151 | A1 | 5/2007 | Pung et al. | |
| 2013/0061875 | A1* | 3/2013 | Woodruff | C25D 17/001 134/6 |
| 2013/0292254 | A1 | 11/2013 | Kumar et al. | |

OTHER PUBLICATIONS

International Search Report and Written Opinion dated Aug. 2, 2019 in International Patent Application No. PCT/US2019/027980, all pages.

* cited by examiner

CLEANING COMPONENTS AND METHODS IN A PLATING SYSTEM

CROSS-REFERENCES TO RELATED APPLICATIONS

This application claims the benefit of U.S. Provisional Patent Application No. 62/660,440, filed on Apr. 20, 2018, and which is hereby incorporated by reference in its entirety for all purposes.

TECHNICAL FIELD

The present technology relates to cleaning operations in semiconductor processing. More specifically, the present technology relates to systems and methods for cleaning residues from electroplating system components.

BACKGROUND

Integrated circuits are made possible by processes which produce intricately patterned material layers on substrate surfaces. After formation, etching, and other processing on a substrate, metal or other conductive materials are often deposited or formed to provide the electrical connections between components. Because this metallization may be performed after many manufacturing operations, problems caused during the metallization may create expensive waste substrates or wafers. One issue during plating is residue buildup on the contact seal against which the substrate may be seated.

Seal cleaning operations may include rinsing, as well as chemical and mechanical cleaning. Cleaning operations may often be performed automatically after a number of wafer cycles in a processing system. By automating the process, system integrity issues may develop including contamination of plating baths with chemical cleaners, or water or chemical agents being injected against contact pins or other conductive components. Additionally, uniformity of cleaning may be difficult and wear on mechanical cleaning elements may increase operating costs.

Thus, there is a need for improved systems and methods that can be used to produce high quality devices and structures. These and other needs are addressed by the present technology.

SUMMARY

The present technology may include systems and methods for cleaning electroplating system components, which may include a seal cleaning assembly incorporated with an electroplating system. The seal cleaning assembly may include an arm pivotable between a first position and a second position. The arm may be rotatable about a central axis of the arm. The seal cleaning assembly may include a cleaning head coupled with a distal portion of the arm. The cleaning head may include a bracket having a faceplate coupled with the arm, and a housing extending from the faceplate. The housing may define one or more arcuate channels extending through the housing to a front surface of the bracket. The cleaning head may also include a rotatable cartridge extending from the housing of the bracket. The cartridge may include a mount cylinder defining one or more apertures configured to deliver a cleaning solution to a pad coupled about the mount cylinder.

In some embodiments, the cartridge may define a first inlet port accessing a first internal annular channel. The cartridge may define a first access channel extending from the first internal annular channel to a distal portion of the cartridge proximate the mount cylinder. The first access channel may extend to a second internal annular channel defined within the cartridge proximate the mount cylinder. The cartridge may define one or more first access channels radially distributed about a central axis of the cartridge. The cartridge may define a second inlet port accessing a central channel defined within the cartridge along a central axis of the cartridge. The cartridge may define a second access channel extending from a distal end of the central channel to a receiving port defined proximate a distal end of the cartridge. The cartridge may define one or more second access channels radially distributed about the central axis of the cartridge, and extending at an angle from the central axis towards a position adjacent an end of the mount cylinder. The cartridge may extend from the bracket at an angle between about −10° and about 40°.

The cleaning assembly may also include a bracket clamp coupled with the housing normal to the front surface of the bracket and configured to secure fluid lines disposed within the one or more arcuate channels. The mount cylinder may extend about and be concentrically aligned with one or more components of the cartridge. The cartridge may further provide the pad positioned about the mount cylinder, and the pad may extend over a first end of the mount cylinder and a second end of the mount cylinder opposite the first end. The pad may be secured between the mount cylinder and the one or more components of the cartridge. The pad may include a multi-layer fabric including an interior fabric and an exterior fabric. The interior fabric may include a knitted polyester material. The exterior fabric may include an ultra-high-molecular-weight polyethylene material. The cartridge may define a third inlet port configured to receive a retaining member, and when the retaining member is disengaged, the cartridge may be configured to rotate about a central axis and adjust an exposed region of the pad.

The present technology may also encompass methods of cleaning an electroplating system seal. The methods may include delivering a cleaning fluid to a cleaning pad positioned on a mount cylinder of a rotatable cartridge. The methods may include engaging an aspirator coupled with the cartridge and configured to retrieve excess cleaning fluid. The methods may include measuring a temperature change at the cleaning pad. The methods may also include performing a seal clean operation with the cleaning pad.

In some embodiments measuring the temperature change at the cleaning pad may include targeting the cleaning pad with an infrared temperature sensor. The measuring may also include measuring a reduction in temperature with the infrared temperature sensor due to evaporation of the cleaning fluid. Performing a seal clean operation may include rotating the electroplating system seal across the cleaning pad. Additional cleaning fluid may be delivered during the rotating, or residual cleaning fluid within the pad may be utilized to perform the seal clean operation. The cartridge may extend from a bracket including a housing defining one or more channels through the housing. One or more fluid lines may be fixed within the one or more channels, and the methods may also include rotating the bracket to position the fluid lines substantially parallel to a leading edge of the electroplating system seal. The methods may also include delivering a rinse fluid through the fluid lines and across the leading edge of the electroplating system seal. The methods may still further include targeting the rinse fluid being delivered with an optical sensor.

The present technology may also encompass cleaning pads, which may be used in seal cleaning as well as any other cleaning operations for which properties of the cleaning pad may be useful. The cleaning pads may include a multi-layer combination material. The materials may include a first fabric layer including a knitted polyester material. The materials may also include a second fabric layer comprising an ultra-high-molecular-weight polyethylene material. In some embodiments the second fabric layer may be positioned external to the first fabric layer. The first fabric layer may also be characterized by grooved fibers configured to facilitate fluid distribution along the fibers.

Such technology may provide numerous benefits over conventional technology. For example, the present technology may provide improved cleaning by utilizing components that ensure more complete wetting of a cleaning pad, and more controlled cleaning of system seals. Additionally, fabrics according to some embodiments of the present technology may afford many more cleaning operations prior to replacement. These and other embodiments, along with many of their advantages and features, are described in more detail in conjunction with the below description and attached figures.

BRIEF DESCRIPTION OF THE DRAWINGS

A further understanding of the nature and advantages of the disclosed embodiments may be realized by reference to the remaining portions of the specification and the drawings.

Figure 1:
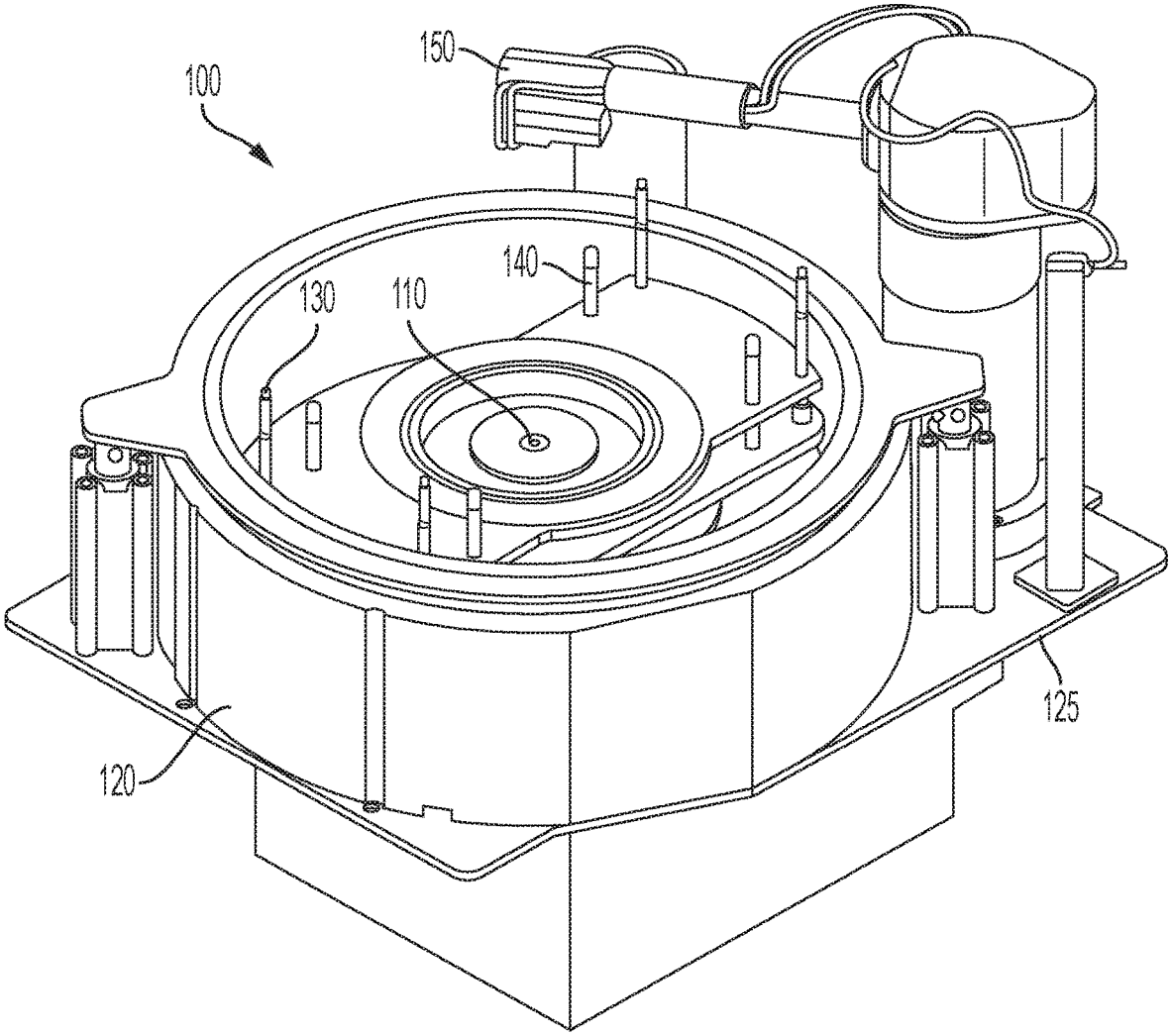
FIG. 1 shows a schematic perspective view of a maintenance module on which cleaning technology may be incorporated according to some embodiments of the present technology.

Several of the figures are included as schematics. It is to be understood that the figures are for illustrative purposes, and are not to be considered of scale unless specifically stated to be of scale. Additionally, as schematics, the figures are provided to aid comprehension and may not include all aspects or information compared to realistic representations, and may include exaggerated material for illustrative purposes.

In the figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION

Various operations in semiconductor manufacturing and processing are performed to produce vast arrays of features across a substrate. As layers of semiconductors are formed, vias, trenches, and other pathways are produced within the structure. These features may then be filled with a conductive or metal material that allows electricity to conduct through the device from layer to layer. As device features continue to shrink in size, so too does the amount of metal providing conductive pathways through the substrate. As the amount of metal is reduced, the quality and uniformity of the fill may become more critical to ensure adequate electrical conductivity through the device. Accordingly, manufacturing may attempt to reduce or remove imperfections and discontinuities in the pathways.

Electroplating operations may be performed to provide conductive material into vias and other features on a substrate. Electroplating utilizes an electrolyte bath containing ions of the conductive material to electrochemically deposit the conductive material onto the substrate and into the features defined on the substrate. The substrate on which metal is being plated operates as the cathode. An electrical contact, such as a ring or pins, may allow the current to flow through the system. This contact may be protected from the electrolyte by a seal, which may prevent metal from being plated on other conductive components. The seal is often a non-conductive material, however, over time the seal may become conductive due to residues formed on the seal during plating operations. During processing, residues may build up on the seal including plating materials, photoresist, or other materials used in processing operations. If the buildup continues, the seal may become sufficiently conductive and plating may occur on the seal. This plating may reduce local plating on the substrate, causing uniformity issues, which may result in scrapped substrates or wafers.

Conventional technologies often halt operations between wafers to clean residues from this seal. The system may be partially disassembled, and the seal may be cleaned and scrubbed manually before being replaced in the tool. This process is time consuming, and abrasive scrubbing may further roughen the seal surfaces increasing the amount of conductive residue that may remain on the seal during processing. Additional automated cleaning operations may also be performed, although automated processes may introduce variables and uncertainty including whether sufficient cleaning agent is being used, whether rinsing operations are being performed, and whether complete cleaning actually occurs.

The present technology overcomes these issues by incorporating an automated seal clean that controls chemical delivery, and monitors cleaning operations. The system may include a priming station ensuring complete wetting of a cleaning pad prior to application on a seal. The cleaning pad may be connected to a cartridge that may be extended against the seal, which may be rotated against the cleaning pad to remove any residues. By utilizing cleaning systems according to the present technology, cleaning may be performed more uniformly, and surface damage to the seal may be limited or reduced by controlling delivery and application of a chemical agent. Additionally, the present technology may perform rinsing operations that pose a reduced likelihood of exposing contact pins and other conductive components to fluid used in the cleaning operations. After describing an exemplary module for exposing and configuring a seal for cleaning by an apparatus according to embodiments of the present technology, the remaining disclosure will discuss aspects of the systems and processes of the present technology.

It is to be understood that the present technology may not be limited to seal cleaning assemblies alone. The present technology may be applicable in a variety of other applications and technologies including where additional materials are to be cleaned, as well as where components or methods of the present technology may be useful. For example, the fabrics, sensing, and other aspects of the present technology may be used in a host of technologies for which properties and characteristics as will be described may be useful either alone or in combination with other aspects of the present technology. Accordingly, the present technology is not to be considered limited by the particular embodiments and combinations described.

FIG. 1 shows a schematic perspective view of a maintenance module 100 on which cleaning technology may be incorporated according to some embodiments of the present technology. After an electroplating or other processing operation, a seal assembly including a substrate having been processed may be transferred to maintenance module 100. As electroplating may be performed with the seal assembly inverted, the assembly may be rotated upright prior to being positioned in the maintenance module. The seal assembly may be attached to lifter 110 via a hub on the seal assembly. The lifter may be lowered to recess the seal assembly towards or within bowl 120 seated on deck plate 125.

In some embodiments the seal assembly may be or include two main components or subassemblies between which a substrate may be retained and sealed against an outer seal portion of the seal assembly. The two components may be coupled in multiple ways, such as via mechanical couplers, vacuum coupling, magnetic coupling, or other mechanisms by which the components may be removably joined. For an exemplary seal assembly joined magnetically, while being lowered with lifter 110, ring pins 130 may engage with the seal assembly, and while the assembly is further lowered, pins 130 may overcome a coupling force to separate the seal assembly and expose a seal to be cleaned. The seal assembly may be further lowered where substrate pins 140 may separate the substrate from a backing plate. A robotic arm may remove the substrate from bowl 120, and a seal cleaning operation may be performed using a seal cleaning assembly 150, which may be rotated within the annular seal, and contacted against the seal to perform a cleaning operation.

The seal may allow isolation of a contact ring from the electrolyte during electroplating operations, and which may prevent plating on a contact ring. The seal may be made of an insulative material, and may be made of materials configured to limit interaction with the electrolyte. For example, the seal material may include a number of polymers including elastomers, and may include fluoropolymers, such as fluoroelastomers, including any FKM materials including Type 1, Type 2, Type 3, Type 4, and Type 5 FKM materials. The materials may also include perfluoroelastomers including any FFKM materials, as well as tetrafluoroethylene/propylene rubbers or FEPM. Seal materials may also include thermoplastic elastomers, including thermoplastic vulcanizates, and elastomers with additional moieties, such as styrene ethylene butylene styrene, as well as materials developed from polyolefins or other plastics. The seal may also include any other materials that may be compatible with electroplating systems and electrolytes.

Figure 2:
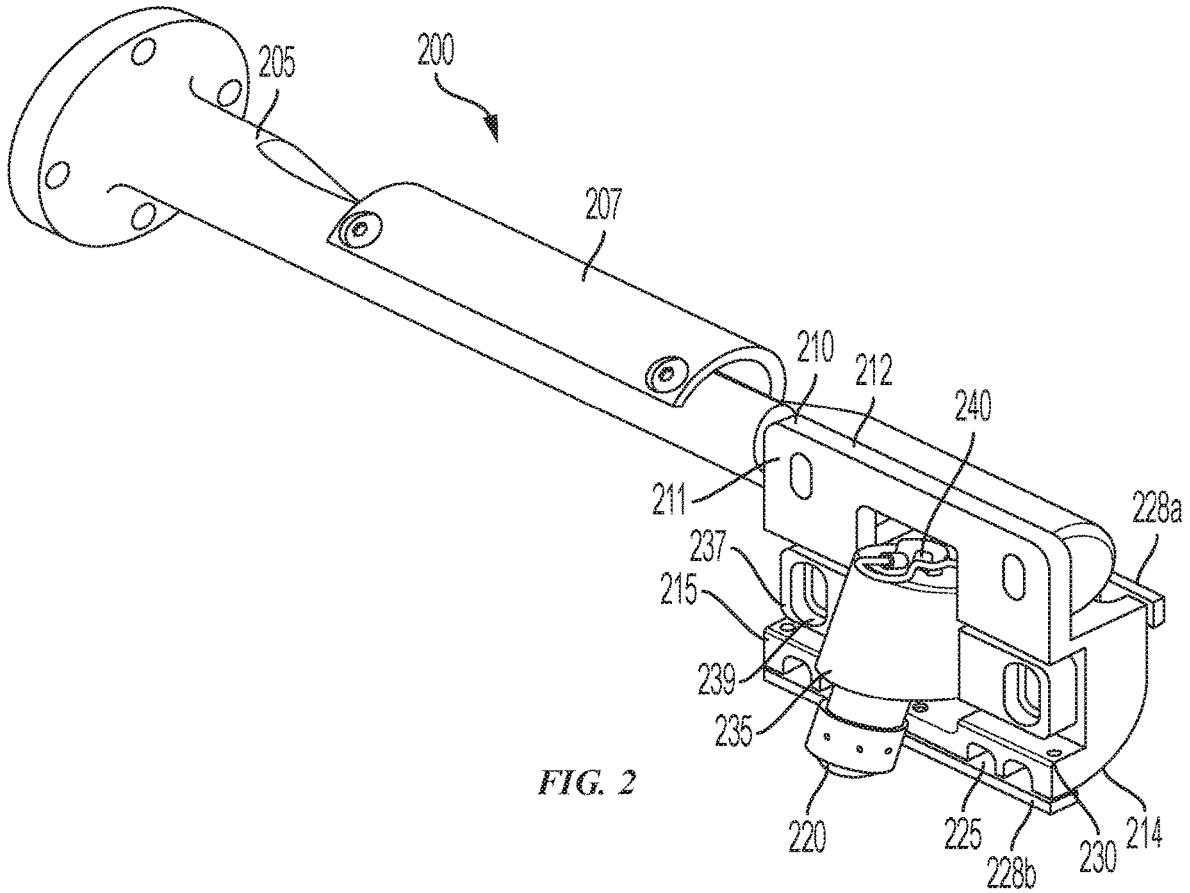
FIG. 2 shows a schematic perspective view of a cleaning assembly according to some embodiments of the present technology.

FIG. 2 illustrates a schematic front perspective view of seal cleaning assembly 200 as may be used in some embodiments of the present technology, and may be similar to seal cleaning assembly 150 noted above. With the substrate removed, and a seal exposed on ring pins 130, seal cleaning assembly 200 may be positioned within the component, and used to clean the interior of the seal, which may have plating or other residues on the surface.

As illustrated, seal cleaning assembly 200 may include an arm 205, and a cleaning head 210. Arm 205 may be a swing arm or other device associated with the electroplating system or a maintenance module for the seal assembly, and may be pivotable between a number of positions including a first position, which may be retracted, and a second position, which may be an operational position and may position a distal portion of arm 205, with which cleaning head 210 may be coupled, at a location that may be vertically aligned with an interior region of the seal exposed in maintenance module 100. Additional operational positions may also be afforded by the design, including during a rinsing operation as will be discussed in detail below. Arm 205 may also be rotatable about a central axis of the arm, which may allow the cleaning head to be raised and lowered to an operational position in which the cleaning head may be in contact with a seal. In some embodiments arm 205 may include a brace 207, which may be used to secure fluid lines extending towards cleaning head 210. Arm 205 may be any number of designs configured to facilitate positioning of the cleaning head 210, and may include a beam as illustrated, or may include an L-shaped or otherwise retractable or extendable arm. As will be described below, arm 205 may be coupled with a torque-controlled motor, which may be incorporated with the arm or connected with the arm. The torque-controlled motor may drive the arm between the first and second positions, and may also be configured to maintain contact between the cleaning head and the seal to be cleaned at a constant force. By maintaining a constant force, any radial runout on the seal may be accommodated to ensure cleaning across an entire radial surface of the seal.

Cleaning head 210 may include a multipart configuration including a main body or bracket 215 and a cleaning cartridge 220. Bracket 215 may include a faceplate 212, by which cleaning head 210 may be coupled with arm 205. Housing 214 may extend from faceplate 212, and may extend below and behind the faceplate and/or arm 205. For example, housing 214 may specifically protrude a distance configured to extend a portion of housing 214 beyond a diameter or width of arm 205, providing access for fluid lines which may be coupled with and extended through housing 214. Housing 214 may in some embodiments extend forward of faceplate 212, although in some embodiments as illustrated, a front surface of the housing may be coplanar with a front surface of the faceplate to define a planar front surface 211 of bracket 215.

Housing 214 may define one or more, such as a plurality, of channels 225 extending from a protruding rear portion of housing 214 towards a front surface of the housing. The channels may be arcuate in profile and shaped to accommodate sized fluid lines, which may be disposed within the channels 225. Although four such channels 225 are illustrated, in other embodiments fewer channels 225 may be defined through housing 214, or more channels may be included. In various embodiments, one, two, three, four, six, eight, ten, or more channels may be included and may be similarly or differently sized from one another. One or more bracket clamps 228 may be used to fix fluid lines within the channels 225. For example, a first bracket clamp 228*a* may be positioned laterally across the one or more channels 225 at an inlet of the channels along the rear of the housing 214. A second bracket clamp 228b may extend adjacent and normal to the front surface of the bracket 215 at outlets of channels 225. Bracket clamp 228b may fix outlets of the fluid lines in position flush or proximate the front surface of bracket 215. Although channels 225 may all be similar in shape and run parallel one another, in some embodiments one or more of channels 225 may be formed to align a fluid line disposed within the channel in a direction offset from one or more other fluid lines. As will be described below, this may afford additional rinsing capabilities for cleaning head 210. Additionally, in alternative embodiments, rinsing lines may be independent of housing 214, allowing alternative configurations and rinsing capabilities from the fixed positions of defined channels within the housing.

Along front surface 211 of bracket 215 may be defined a recess 230 within which cleaning cartridge 220 may be positioned. Recess 230 may be formed below faceplate 212 laterally across bracket 215, although a portion of recess 230 may extend within faceplate 212 to accommodate portions of cleaning cartridge 220. Cleaning cartridge 220 may include a cartridge housing 235 encasing a portion, such as an upper portion, of the cleaning cartridge. Cartridge housing 235 may be positioned within recess 230, and may include flanges 237 defining apertures 239 through which mechanical coupling may be made between the cartridge housing 235 and the bracket 215.

Cleaning cartridge 220 may be rotatably coupled within cartridge housing 235, and may include a number of attachment mechanisms allowing rotation. For example, in some embodiments cleaning cartridge 220 may be coupled through cartridge housing 235 with a fastener, such as cotter pin 240 as illustrated. The cotter pin may be removed allowing rotation of the cleaning cartridge 220 within the housing. In some embodiments, cleaning cartridge 220 may not be rotatable within cartridge housing 235, but may be removably coupled within the housing. After component wear to the cartridge, the cartridge may be removed to allow replacement of worn materials. Additional aspects of the cleaning cartridge 220 as well as alternative connection mechanisms will be described in further detail below.

Cleaning head 210 may be made of any number of materials or combinations of materials. In some embodiments, the cleaning head 210 may be a machined metal or plastic component, and may include a material that may be resistant to damage from cleaning solutions that may be used. For example, as will be explained in relation to the operational method below, the cleaning solutions may include an acidic solution in some embodiments. Accordingly, cleaning head 210 may include materials that are resistant to acidic solutions that may flow through the cleaning head. Additionally, water, either in the acidic solutions or with a separate delivery, may be flowed through the cleaning head 210, and the material may be resistant to water corrosion as well.

Figure 3:
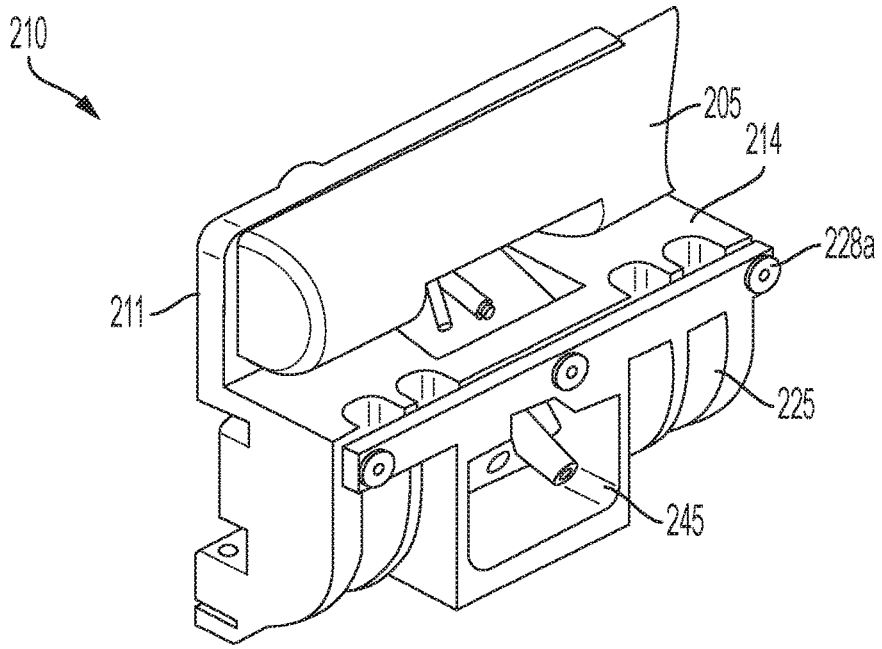
FIG. 3 shows a schematic perspective view of a cleaning head according to some embodiments of the present technology.

FIG. 3 shows a schematic perspective view of cleaning head 210 according to some embodiments of the present technology, and may illustrate a rear perspective view of the cleaning head. As noted previously, housing 214 may extend behind arm 205 to provide access for fluid lines to be positioned within channels 225. Channels 225 may be closed channels in embodiments, or may be open channels defined along housing 214. Bracket clamp 228a may secure fluid lines delivered into the channels and positioned along housing 214 towards the front surface 211 of bracket 215. As illustrated in FIGS. 2 and 3, cleaning cartridge 220 may be positioned centrally within bracket 215, and channels 225 may be distributed on either or both sides of the cleaning cartridge. Housing 214 may also define an access window 245, which may allow fluid lines to be coupled with cleaning cartridge 220. The fluid lines for cleaning cartridge 220 may similarly be extended along arm 205 along with fluid lines to be positioned within channels 225, and may include similar or different fluid lines. As one non-limiting example, fluid lines positioned within channels 225 may include water lines or rinse agent lines, while the fluid lines to be coupled with cleaning cartridge 220 may include chemical lines and aspirate lines. Operational use of these fluids will be described further below.

Figure 4A:
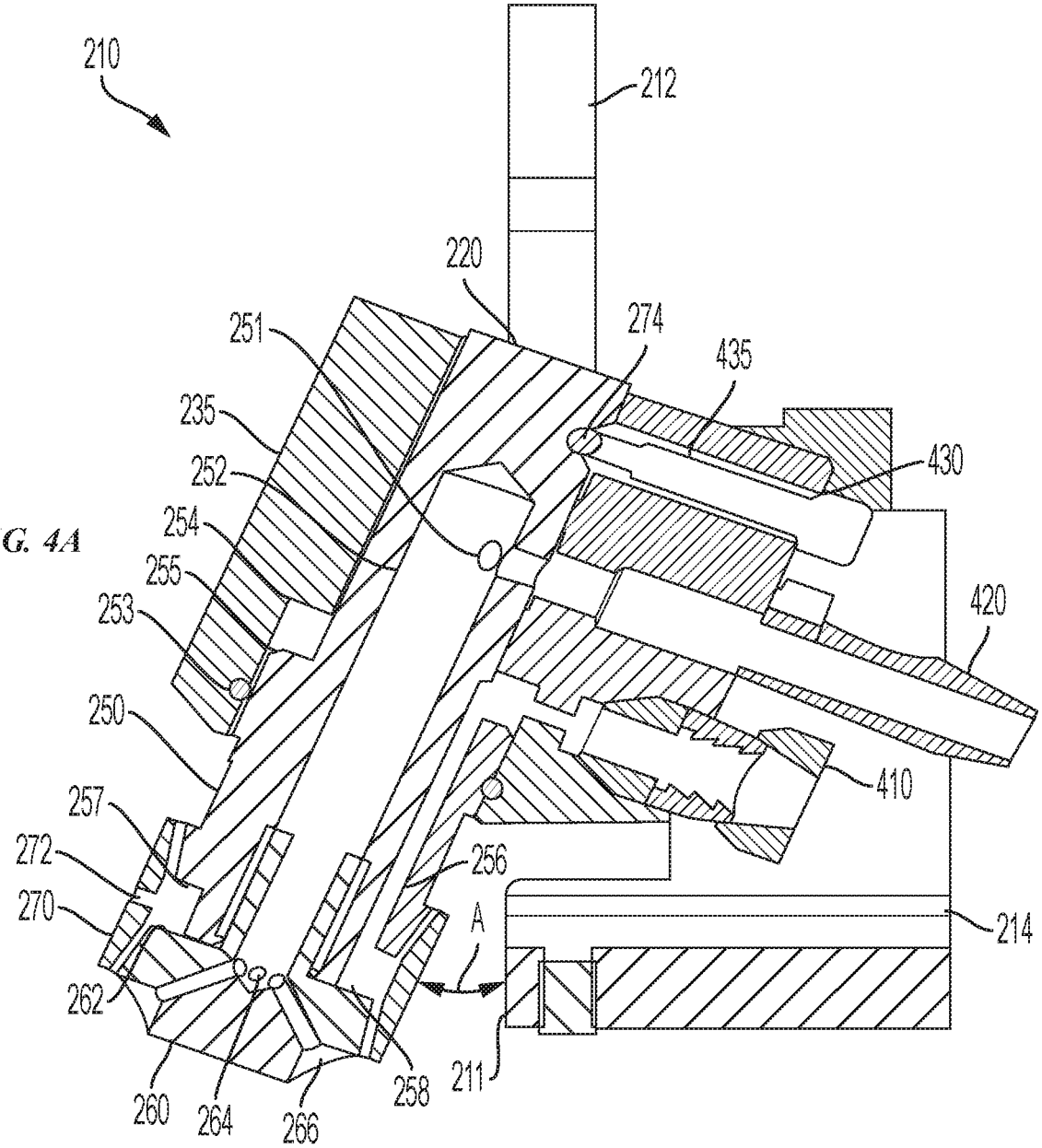
FIG. 4A shows a schematic cross-sectional view of a cartridge of a cleaning head according to some embodiments of the present technology.

Turning to FIG. 4A is shown a schematic cross-sectional view of a cleaning cartridge 220 of a cleaning head 210 according to some embodiments of the present technology. The figure may illustrate a partial view of the cleaning head 210 illustrated in FIG. 2, and may show faceplate 212 and housing 214 of bracket 215, with which cleaning cartridge 220 is coupled. Cleaning cartridge 220 may extend at an angle A from bracket 215, and more specifically from a front surface 211 of bracket 215. The angle of the cleaning cartridge may be determined based on an orientation of a seal to be cleaned. For example, exemplary seals may extend about a lip of a structural component, and thus a portion of the seal to be cleaned may be characterized by an angle as well. Cleaning cartridge 220 may be positioned at any angle relative to the seal to be cleaned, and in some embodiments cleaning cartridge 220 may be positioned at an angle relative to bracket 215 that is greater than an angle of the associated seal, which may facilitate contact against the seal for cleaning. In embodiments the cleaning cartridge may be positioned at an angle A from the bracket between about 10° and about 45°, and in some embodiments may be positioned at an angle of between about 12° and about 30°, between about 15° and about 25°, or within any smaller range within these stated ranges. It is to be understood, however, that cleaning cartridge 220 may be positioned at virtually any angle between −10° and 180° relative to the housing in different configurations to accommodate additional and alternative components to be cleaned.

Cleaning cartridge 220 may include one or more components that interconnect to produce a cleaning attachment that may be used to mechanically and/or chemically clean a seal against which the cartridge is placed. In some embodiments the cleaning cartridge may include three major components, although fewer components or a greater number of components may be incorporated, as well as any number of lesser components of the cartridge. Cleaning cartridge 220 may include an upper insert 250, a lower insert 260, and a mount cylinder 270. Upper insert 250 may be positioned within cartridge housing 235 at a first end, and may be accessible from an access through a top portion of the housing. Lower insert 260 may couple with a second end of upper insert 250, and may be press fit, snap fit, threaded, or otherwise coupled, including mechanically or adhesively coupled, within upper insert 250.

Upper insert 250 may partially define a central channel 252 extending coaxially along a central axis through cleaning cartridge 220. At a distal end of the upper insert 250 may be threads or an additional recess within which lower insert 260 may be coupled. The connected components may together fully define central channel 252. Upper insert 250 may also be characterized by an outer profile that when coupled within cartridge housing 235 may further define a first annular channel 254 between the two components. Cartridge 220 may be sealably coupled within cartridge housing 235, such as with an elastomeric element or o-ring 253, which may limit or prevent fluid egress from between cartridge 220 and cartridge housing 235. A ledge 255 defined along the outer profile of cartridge 220 may be positioned proximate a ledge defined within cartridge housing 235 to define first annular channel 254 internally within the cleaning head 210. Cartridge housing 235 may define a first inlet port 410 which may fluidly access the first annular channel 254 at a radial edge of the channel. Fluid delivered through first inlet port 410 may flow about the annulus formed between the cartridge and housing.

Ledge 255 of upper insert 250 of cartridge 220 may provide access to one or more first access channels 256, which may provide fluid distribution paths from first annular channel 254 through the cartridge and into a second annular channel 258 defined internally within the cartridge at a distal location, such as proximate mount cylinder 270. Although a single first access channel 256 is illustrated, in some embodiments one or more first access channels may be radially distributed about a central axis of the cartridge and defined through upper insert 250.

Second annular channel 258 may be defined at least partially by each of upper insert 250, lower insert 260, and mount cylinder 270 as illustrated. For example, upper insert 250 may define a second ledge 257 similar to first ledge 255, and through which first access channels 256 may exit into second annular channel 258, delivering fluid provided through first inlet port 410. Lower insert 260 may seat against a distal end of upper insert 250 and extend radially outward from upper insert 250 to define a lower ledge 262 defining second annular channel 258 from below. Mount cylinder 270 may be positioned about and concentrically aligned with upper insert 250 and lower insert 260. The mount cylinder 270 may define an outer radial edge of second annular channel 258. Mount cylinder 270 may define one or more apertures, such as a plurality of apertures 272 through the cylinder. Apertures 272 may provide access from second annular channel 258 to deliver a fluid from cartridge 220. As will be explained in detail below, a cleaning pad may be coupled about mount cylinder 270, and may receive a fluid, such as a cleaning solution, delivered through apertures 272. The mount cylinder 270 may be shaped to accommodate the cleaning pad, as well as to accommodate a seal to be cleaned, which may be characterized by curvature along the face of the seal. Accordingly, mount cylinder 270 may be characterized by an annular or cylindrical profile, and a degree of curvature similar to or common with an amount of curvature of a seal to be cleaned. Mount cylinder 270 may also be characterized by additional geometric shapes including polygons providing a number of faces. However, polygonal profiles may reduce contact of a cleaning pad about the mount cylinder, which may affect cleaning fluid diffusion throughout the pad.

Cartridge housing 235 may also define a second inlet port 420. Although inlet ports defined through cartridge housing 235 may be positioned at any location, in some embodiments, second inlet port 420 may be positioned axially above first inlet port 410. Second inlet port 420 may fluidly access central channel 252 defined through upper insert 250 and lower insert 260. Within lower insert 260, central channel 252 may distribute to or be accessed by one or more receiving ports, or a plurality of receiving ports 264 defined proximate or about a distal end of central channel 252. Receiving ports 264 may provide fluid access to the central channel from one or more, or a plurality, of second access channels 266 defined through lower insert 260 of cartridge 220. As illustrated, second access channels 266 may be radially distributed about an end of central channel 252, and may be angled from a central axis through cartridge 220 towards mount cylinder 270. Second access channels 266 may flare at or towards an exterior edge of lower insert 260, which may further extend the channels towards a position adjacent a lower end of mount cylinder 270.

The coordination and organization of volumes within cleaning head 210 may provide fluid paths through the apparatus that may accommodate controlled delivery and/or collection of a fluid. For example, a cleaning fluid may be delivered through first inlet port 410, and may be forced or flowed through first annular channel 254, first access channels 256, and apertures 272 into a cleaning pad positioned on the mount cylinder 270. By utilizing the collection of channels, the delivery may be maintained at a low delivery rate to allow distribution of the cleaning fluid through the cleaning pad by absorption into the material, which may limit droplets from the cleaning pad. Additionally, an aspirator may be connected with second inlet port 420, which may allow any excess cleaning fluid to be collected instead of falling to surrounding surfaces. For example, as cleaning fluid may fall from a cleaning pad on mount cylinder 270, the fluid may be drawn into second access channels 266, through central channel 252, and out second inlet port 420 to be collected. This combination of fluid paths may limit or prevent cleaning fluid from flowing beyond the cleaning pad.

Cartridge housing 235 may define a third inlet port 430 configured to receive a retaining member configured to at least partially fix a position of the cartridge within the housing. The retaining member may include a number of materials configured to substantially maintain a position of the cartridge within the cartridge housing. Exemplary retaining members may include a set screw, plunger, or any other component that may maintain cartridge 220 at a set position within cartridge housing 235. FIG. 4A illustrates a spring-loaded plunger 435 that may seat in a notch 274 formed in upper insert 250 of cartridge 220. When the plunger is disengaged, cartridge 220 may be configured to rotate about a central axis within cartridge housing 235. This may allow an exposed region of a cleaning pad to be adjusted. Cleaning head 210 may have a number of set positions formed, such as by forming one or more, or a plurality of notches 274 about upper insert 250. Thus, as cartridge 220 is rotated to the next notch 274 that will seat plunger 435, the cleaning pad may be rotated further. Additionally, a set screw may provide fine tune control over the rotation of the cartridge 220, and in such configurations, notches 274 may not be formed. Guidelines or other visual or mechanical indications may be formed along one or more components of cartridge 220 to facilitate positioning of the cartridge. Because of the rotation capability of cartridge 220, second inlet port 420 may be coupleable with multiple accesses 251 of central channel 252. For example, while first access port 410 delivers into a channel, and thus rotation of the component may not affect delivery, rotation may otherwise seal inlet port 420 from the central channel. Accordingly, a number of accesses 251 may be formed through upper insert 250 to maintain access into central channel 252 during rotation operations. Accesses not aligned with the second inlet port 420 may be sealed against a surface of cartridge housing 235 in some embodiments.

When positioned against a seal to be cleaned, only a portion of the cleaning pad may contact the seal itself. By allowing rotation of a cleaning pad with some embodiments of the present technology, cleaning pads may be maintained for longer periods than many conventional designs. As one non-limiting example, by including five set rotation positions for the cartridge 220, a cleaning pad may perform up to five times as many cleaning operations by repositioning the pad via rotation after wear of the contact position is detected or estimated. In many conventional technologies a cleaning pad may be coupled at a single position, and thus when the contact portion indicates wear, the entire pad may be replaced, regardless of the integrity of other portions of the pad. Accordingly, the present technology may increase cleaning lifetime and reduce replacement costs of cleaning pads used in embodiments of the present technology.

Figure 4B:
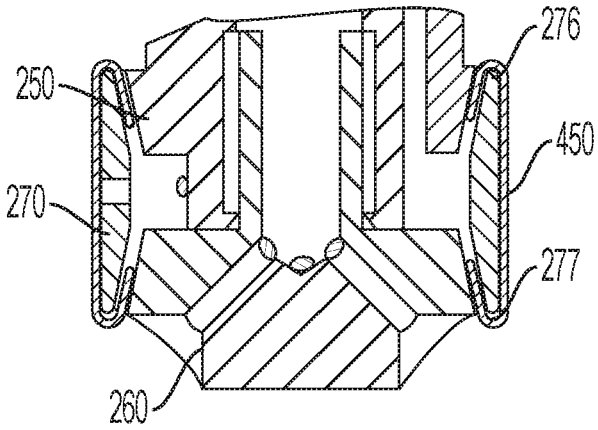
FIG. 4B shows a schematic cross-sectional view of a detailed portion of the cartridge illustrated in FIG. 4A according to some embodiments of the present technology.

Cleaning pads according to the present technology may be held in place between the mounting cylinder and the upper insert 250 and lower insert 260. The cleaning pads may be a sleeve or wrap positioned about the mounting cylinder, and may be characterized by a height greater than a height of the mounting cylinder 270. Excess material from the cleaning pad may be retained above and below the mounting cylinder and clamped with the upper and lower inserts. FIG. 4B shows a schematic cross-sectional view of a detailed portion of the cartridge 220 illustrated in FIG. 4A according to some embodiments of the present technology. The figure shows one form of coupling a cleaning pad 450 with the cartridge, although many variations are similarly encompassed by the present technology. For example, adhesive or mechanical fasteners may be used to fix the cleaning pad on the mount cylinder in other embodiments.

Exterior profiles of each of the upper insert 250, lower insert 260, and mount cylinder 270 may be formed to accommodate a cleaning pad. Mount cylinder 270 may taper from a center of the component towards one or both of a first end 276 and a second end 277 opposite the first end of the mount cylinder 270. The components of the cartridge may be joined in any number of ways, and in some embodiments, subsequent positioning of the cleaning pad 450 over the mount cylinder 270, a first amount of the cleaning pad extending beyond first end 276 may be folded over first end 276, and compressed against upper insert 250 as mount cylinder 270 is positioned over a distal end of upper insert 250. An amount of the cleaning pad extending beyond second end 277 may then be folded over second end 277, and compressed against lower insert 260, as lower insert 260 is positioned into and coupled within upper insert 250. This operation may securely fix the cleaning pad within the cartridge, and form a seal about the mount cylinder 270 and the other cartridge components. Additionally, one or both of upper insert 250 and lower insert 260 may flare in a direction of taper of the mount cylinder 270 to further clamp the cleaning pad 450 against the components. Consequently, cleaning fluid delivered into the second annular channel of the cartridge may be controlled to only exit the channel from the apertures defined in the mount cylinder and seep or otherwise be absorbed into the cleaning pad 450. Engagement of the aspirator may further seat and compress the cleaning pad strengthening the formed seal.

Cleaning pads according to some embodiments of the present technology may include a variety of material properties configured to both uniformly deliver a cleaning fluid through the pad, as well as withstand numerous contact cleaning operations. Additionally, the cleaning pads may be inert to acids or other chemicals used as cleaning agents in various cleaning operations according to the present technology. Although a variety of single component cleaning pads may be used exhibiting a combination of these properties, in some embodiments a multi-layer material or combination may be used. For example, a multi-layer fabric composite may be used as a cleaning pad according to some embodiments of the present technology. An exemplary composite may include at least two fabric layers including a first fabric layer, such as an interior fabric layer, seated against the mount cylinder. The composite may also include a second fabric layer, such as an exterior fabric layer, configured to contact a seal and perform a cleaning operation.

The interior fabric layer may be characterized by superior absorption and distribution properties to efficiently distribute fluid delivered through apertures of the mount cylinder across the cleaning pad. Exemplary materials may include organic or inorganic fiber materials, and may include woven, knitted, and/or layered fabrics or materials. The material may have a directionality to the weave or the fibers themselves to facilitate delivery of a fluid through and across the material. For example, grooved fibers may be used to facilitate capillary action across the fibers. When multiple layers of material are utilized in the first layer, the layers may have alternating or rotating directionality between layers to further promote distribution through and across the material. The layers may be laminated to increase mechanical properties of the material. One non-limiting material that may be used in exemplary cleaning pads is a knitted polyester fiber material, although other polymer fiber materials may be used.

The exterior fabric layer may be characterized by superior wear resistance to extend useful life of the cleaning pad. Additionally, the exterior fabric may be selected to limit abrasion to seals being cleaned by the pad. The exterior fabric may be a woven fiber material or fabric.

The exterior may have a directionality component related to wear, and may be incorporated on the cleaning pad in a configuration based on a direction of seal rotation, and thus direction of abrasion. Exemplary materials may include one or more layers of material that may include a variety of materials selected for wear resistance, chemical compatibility, and resistance to abrasion of seals being cleaned. For example, materials may include ceramics, polyaramid fibers or materials, carbon fibers or materials, fluoropolymeric materials including fluorocarbon fabrics that may include ethylene chlorotrifluoroethylene or polytetrafluoroethylene, polyethylene fibers or materials including high- and ultra-high-molecular-weight polyethylene materials, polyamide fibers or materials, or other materials that may provide any of the mechanical or material properties noted.

Figure 5:
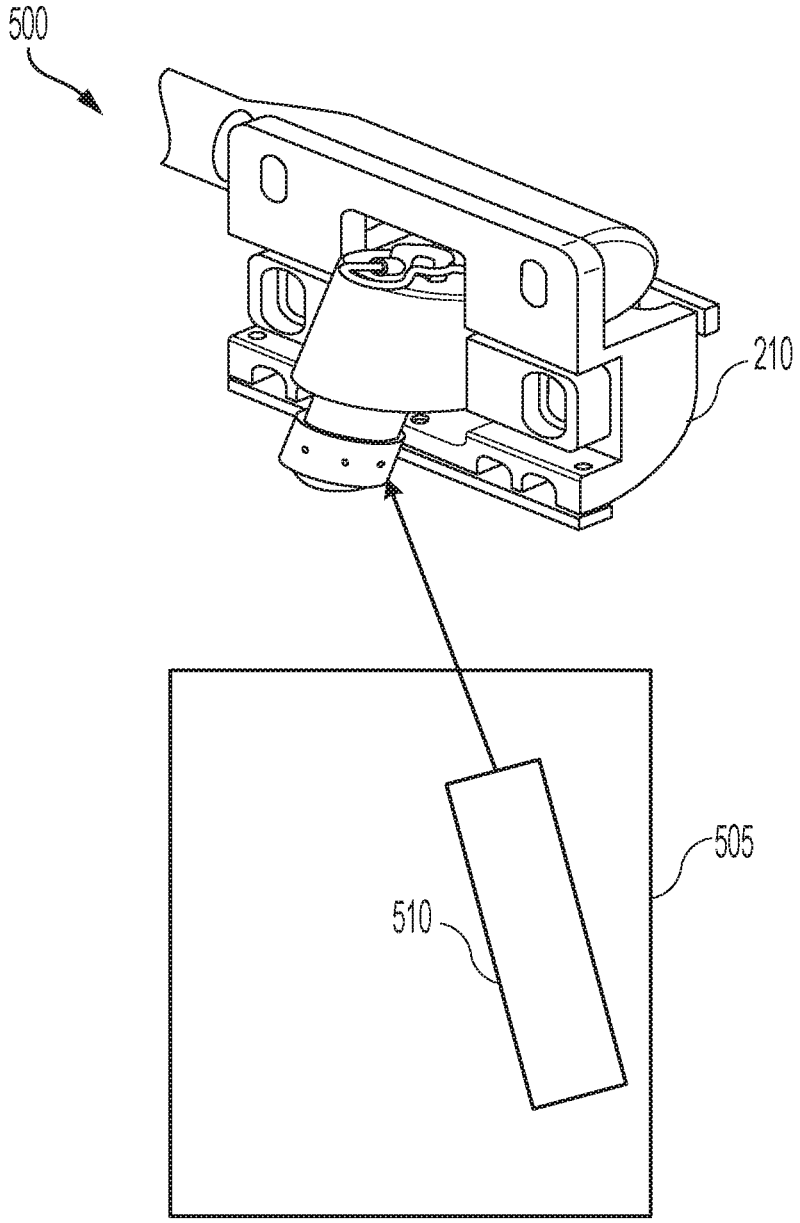
FIG. 5 shows a schematic view of a sensor setup for priming a cleaning head according to some embodiments of the present technology.

Cleaning operations according to the present technology may utilize additional features to ensure wetting of the cleaning pad prior to application on a seal, which may reduce wear and/or abrasion of the contacting materials. FIG. 5 shows a schematic view of a sensor setup 500 for priming a cleaning head according to some embodiments of the present technology. Prior to a cleaning operation, a cleaning pad incorporated on a cleaning head 210 according to embodiments of the present technology may be primed with a cleaning agent, such as a chemical agent. In automated cleaning operations, ensuring that the cleaning pad is wetted with the cleaning agent may be difficult without oversaturating the pad, and causing excess fluid to drip from the pad. Embodiments of the present technology perform a priming cycle in which the wetting is performed while monitoring the operation.

As illustrated in FIG. 5, a cleaning head 210 may be positioned proximate a recovery or dispense cup 505 to collect excess fluid if formed. Positioned proximate the dispense cup, attached to the dispense cup, or otherwise positioned to target the cleaning pad may be a sensor 510 for measuring temperature, such as an infrared temperature sensor. As previously described, an aspirator may be coupled with the cleaning head to collect fluid delivered through the cleaning pad. The temperature sensor may target the pad and report the temperature of the fluid being delivered into the pad, or an ambient temperature or component temperature if similar. During the chemical delivery, the aspirator may be engaged, which may cause evaporation of some chemical agent as it is being delivered. As the chemical agent evaporates and causes air movement, the temperature sensor may record a temperature characterized by a reduction or delta relative to an ambient temperature of the surrounding environment caused by cooling at the pad surface due to evaporation across the pad. The sensor may adjust from reading a bulk fluid temperature to reading a wet-bulb temperature and thus register an active reduction in temperature at the pad, or may be used in a determination of pad temperature relative to ambient temperature. The resulting temperature reduction or differential may be identified to determine that the cleaning pad has been sufficiently wetted, and a cleaning operation may be performed.

Figure 6:
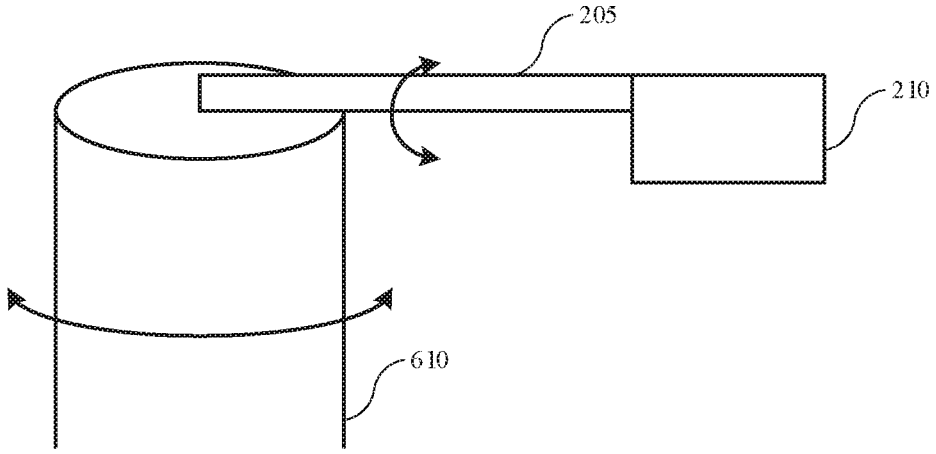
FIG. 6 shows a schematic view of a cleaning head in operation according to some embodiments of the present technology.

FIG. 6 shows a schematic view of a cleaning head in operation according to some embodiments of the present technology. The illustration shows positioning operations that may be performed during cleaning operations. The apparatus illustrated may include a base 610 within which the torque-controlled motor noted previously may be connected. Coupled with base 610 may be arm 205, with which cleaning head 210 may be coupled at a distal location. Although shown schematically, it is to be understood the arm and cleaning head may include any of the features or components previously described. As discussed above, base 610 may be operable to pivot or swing arm 205 allowing cleaning head 210 to be positioned relative to a seal or other device to be cleaned.

Cleaning head 210 may be rotated during operations, and may be maintained in a retracted or withdrawn position during operation of base 610, which may involve rotating the cleaning head upwards, which may facilitate positioning cleaning head 210, while limiting the opportunity of cleaning head 210 to contact the seal or other components. By maintaining cleaning head 210 in a downward facing position, such as recessed upwards, cleaning head 210 may be passed over a seal to be cleaned before being positioned in contact with the seal. This position may also be used to perform rinsing operations as will be described further below. FIG. 6 illustrates one possible system for delivering cleaning head 210 to a seal or component to be cleaned, but it is to be understood that any system may be used to pivot, rotate, or otherwise position cleaning head 210 against a seal to be cleaned.

Figure 7:
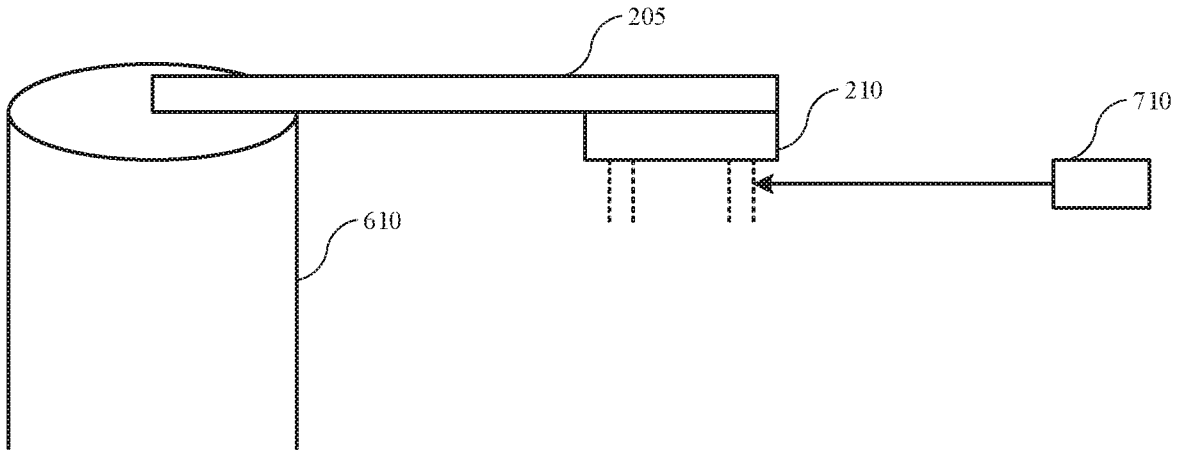
FIG. 7 shows a schematic view of a cleaning head in operation according to some embodiments of the present technology.

FIG. 7 shows a schematic view of a cleaning head 210 in operation according to some embodiments of the present technology. The figure illustrates a possible rinsing operation that may be performed using seal cleaning assemblies according to embodiments of the present technology. Subsequent a seal clean with a chemical agent delivered through a cleaning pad, residual chemical agent may be on the seal. A rinsing operation may be performed using fluid lines positioned within the cleaning head, such as disposed within channels 225 described above. When the cleaning head 210 is in a seal clean position where the cleaning pad may contact the seal, the fluid channels, which may be flush to the front surface 211 of the cleaning head, may be positioned for a direction of fluid flow that is normal to the seal. Although in some embodiments a rinse operation may be performed in this configuration, in some embodiments a rinse may be performed subsequent the seal clean operation. When positioned normal to the seal surface, or in line with a contact ring or internal components, projected rinse fluid may clear residual chemical agent, but may flow the dilute agent within or in contact to other seal components, such as contact pins or retaining elements. To limit or prevent this direction of flow, some embodiments of the present technology may perform a rinsing operation tangentially across a face of the seal, to facilitate removal of residual chemical agent.

In some embodiments, the cleaning solution may be or include an acidic solution. Residues left on a seal may include metal ions or materials on the surface of the seal, which may be removed with acidic materials. The chemical agent utilized with cleaning head 210 may be selected based on the metal that may have been electroplated in the previous chamber, and may include nitric acid, acetic acid, sulphuric acid, or any other organic or inorganic acid as well as acid mixture that may facilitate removal of copper materials, nickel materials, tin-silver solders, or other materials that may be electroplated and may cause residues to form on the seal, including metal-organic materials and complexed metals, such as, for example, silver in a tin silver bath.

Subsequent a cleaning operation, cleaning head 210 may be rotated up to position the fluid channels to have a downward fluid delivery, which may be straight down or at a downward angle. The arm 205 may be additionally pivoted to position the fluid lines over the seal, and a rinse fluid, such as an additional chemical agent or water, including deionized water, may be flowed over the seal surfaces. As explained previously, fluid lines or channels conducting fluid lines may be parallel or offset from one another, which may perform a rinse over a more complete area of the seal. The rinse fluid may then be flowed downward over the seal in a parallel or substantially parallel position relative to a leading edge of the seal. The seal itself may have a number of profiles, which may not include a vertical wall at the leading edge. However, it is to be understood that by parallel may be meant a flow, such as from above, across the seal, or downward and over an outer surface of the seal, as opposed to an ejection of fluid straight on or normal to the seal surface, regardless of the seal profile. By allowing rinse fluid to flow across the seal surface, and drop downward into a collection bin, such as a bowl of the maintenance module, cleaning fluid may be rinsed from the seal with little opportunity for flow that may recess back behind the seal onto the contacts or retaining elements, such as may occur by a direct flow or a flow normal to a surface of the seal. Ensuring delivery of the rinse fluid may be performed with an additional sensor 710, such as an optical sensor. The sensor may be positioned to target where rinse fluid may be delivered, and may identify whether the rinse is being performed. This may provide assurance during automated processes that chemically cleaned seals are being properly rinsed prior to additional use.

Figure 8:
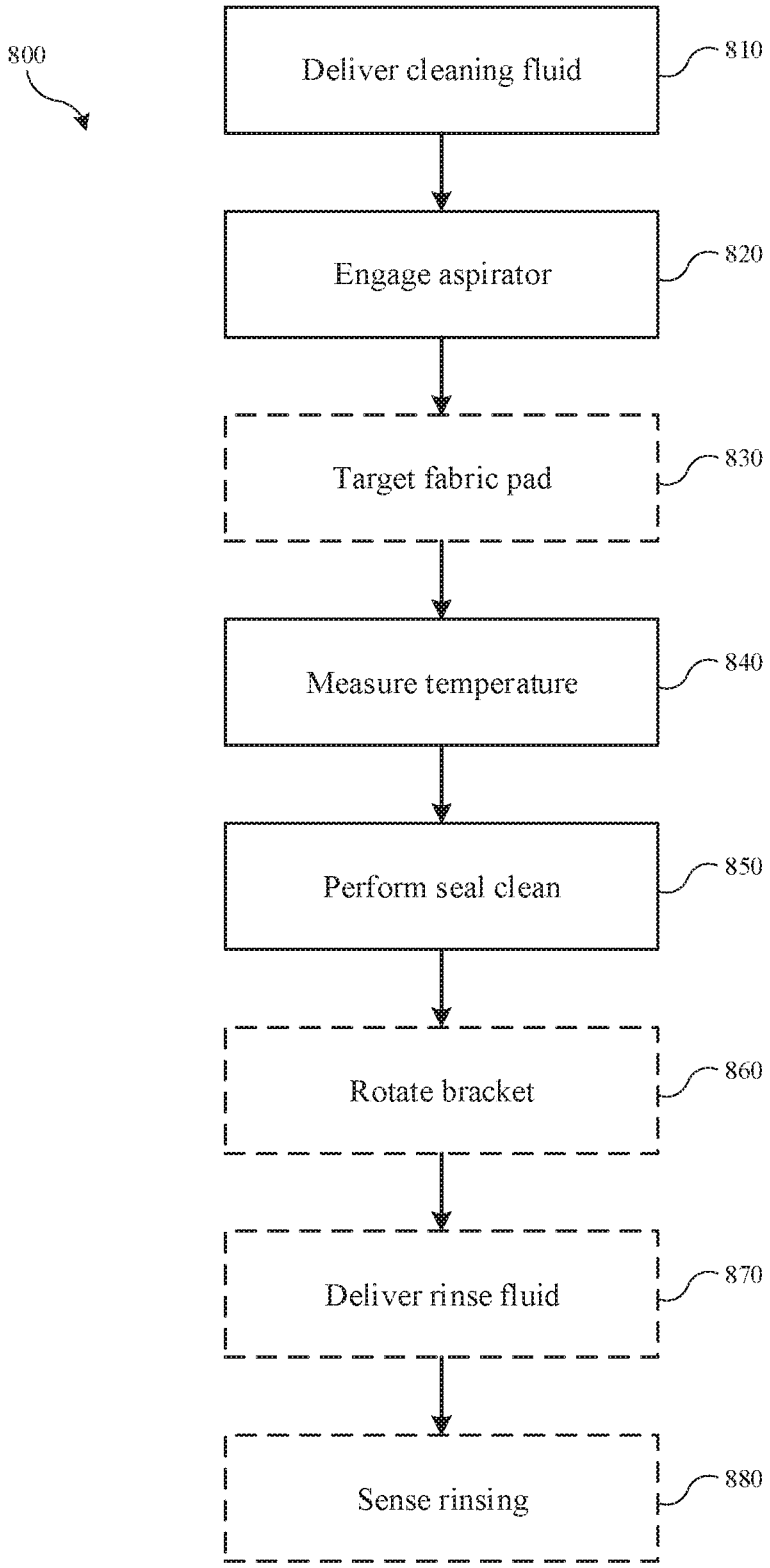
FIG. 8 shows operations of an exemplary method of cleaning a contact seal according to some embodiments of the present technology.

The systems and components previously described may be used in a number of methods for performing component cleaning. FIG. 8 shows operations of an exemplary method 800 of cleaning a system seal of an electroplating system according to some embodiments of the present technology, and which may use any of the components previously described, such as cleaning head 210. Method 800 may include operations prior to the actual seal cleaning. For example, prior to the cleaning, a system seal may be positioned, to expose a contact seal or other component to be cleaned as previously explained with regard to the maintenance module 100 described above.

Method 800 may include a number of operations that may be performed automatically within a system, to limit manual interaction. Method 800 may include operations to prime or prepare the cleaning pad prior to contacting a seal to be cleaned. An arm may position the cleaning head for priming either where the cleaning may occur, or in a separate location, such as over a drain or dispense cup as previously described. At operation 810 a cleaning fluid may be delivered onto a cleaning pad, which may be positioned on a mount cylinder of a rotatable cartridge, such as cartridge 220 previously described. An aspirator coupled with the cartridge may be engaged at operation 820. The aspirator may be configured to retrieve excess cleaning fluid, which may otherwise be expelled from the pad once saturation has been reached. Method 800 may optionally include targeting the fabric pad with a temperature sensor, which may be an infrared temperature sensor at optional operation 830. The method may then include measuring a temperature differential at the fabric pad at operation 840, which may be indicative of cleaning fluid having wetted the cleaning pad, and being evaporated, which may register a lower temperature than an ambient temperature of a surrounding environment. The measurement may include measuring a reduction in temperature with the sensor relative to ambient, and the reduction in temperature may be due to evaporation of cleaning fluid caused by the aspirator. Once the differential has reached a predetermined amount, which may confirm adequate wetting of the pad, the pad may be used for cleaning.

A seal clean operation may be performed at operation 850, which may chemically and/or mechanically clean the seal. The seal clean operation may include rotating the seal to be cleaned and contacting the seal with the wetted cleaning pad. The contacting and rotating may happen simultaneously, or in any order. The seal may be rotated across the cleaning pad while additional cleaning fluid is delivered through the cartridge into the pad, such as via apertures in the mount cylinder as described above. In some embodiments, the original amount of fluid delivered may be sufficient to perform the cleaning operation, and no additional cleaning fluid may be flowed during the rotating operation. An optional rinsing operation may be performed subsequent the cleaning operations. The bracket of the cleaning head may be rotated up at optional operation 860, which may, for example rotate the cleaning head about 90° to position fluid lines disposed in channels of the cleaning head in a direction substantially parallel to a leading edge of the seal, or positioned to provide fluid flow downward over the seal as opposed to normal to a leading edge of the seal. An additional translation of the cleaning head may also be performed to align the fluid lines with the seal face. A rinse fluid, such as deionized water, may be delivered through the fluid lines and flow across or downward over the leading edge of the seal at optional operation 870. The rinsing may dilute any residual cleaning fluid, and/or remove the fluid from the seal. In some embodiments, an optical sensor may be engaged to sense whether the rinsing operation is being performed at optional operation 880. The sensing may provide confirmation during automated operations to ensure the seals are properly cleaned and rinsed prior to subsequent use.

The technologies of the present disclosure may provide a variety of advantages over conventional technologies. Cleaning pads according to various embodiments may provide superior cleaning, while providing extended life. Sensing capabilities according to various embodiments may provide confirmation of automated processes to ensure operations are performed sufficiently, including cleaning pad wetting and seal rinsing. Additionally, improved hardware according to some embodiments may allow additional use of cleaning pads and improved cleaning operations to increase cleans available per cleaning pad, and provide improved removal operations.

As previously noted, cleaning fluids according to the present technology may be specifically configured for the material that may reside on the seal to be cleaned. Conventional cleaning processes have often focused on chemistries or physical mechanisms targeted at removing metals and metal ions on the polymer seal surface. Often, the material to be cleaned is invisible to the naked eye. However, testing has shown that even daily wipe downs with 20% nitric acid may increase the time between plate-up occurrences significantly, such as from doubling the time to increasing the time to plate-up by over tenfold. Plate-up will still occur, though, and observation in some instances illustrates that material may be collecting on seal surfaces that may not be cleaned adequately in a daily operation, indicating the need for an improved cleaning process to prevent seal plate-up. Improved seal cleaning processes may use both the assemblies described previously, as well as particular cleaning solutions.

Often a discoloration may gradually form on the plating seals. Experiments have shown this discoloration may be due to the gradual build-up of organic based deposits on the seal. The source of the organic material may be from photoresist or solvents from the wafers being processed. Additionally, the build-up may be from the deposition of organic compounds which are a part of the plating bath. These would include the family of organic additives such as accelerators, levelers, and suppressors in copper plating baths and chelating agents and complexing agents in tin silver baths. Due to the characteristics of these organic compounds, which are specifically designed to bond with and interact with metal ions in solution as the metal ions plate onto what should be electrically neutral polymer surfaces such as the seals in the plating chamber, the organic compounds may be accompanied by metals, which are conductive and may alter the surface of the polymer seal to have some degree of conductivity not previously present. The result may be that these plated materials will create conductive paths or shorten the conductive path to the electrically charged contacts and provide a source of electrons to the insulating surface resulting, eventually, in plate-up. In some instances, plate-up has been observed to have occurred specifically on top of observed organic filaments. This may indicate that the organic material may be acting as an adhesion layer or precursor which eventually allows or creates the conductive path from the contacts or charge tunneling site through the seal to the seal surface, resulting in plate-up. Thus, while the removal of metals and metallic ions from the surface is desirable, such operations may not be addressing the underlying problem related to the organics.

While strong caustics are known to be effective at removing organic materials, such removal may often be accomplished only over extended time and at elevated temperature. While such a procedure may be accomplished with success, it may be difficult to include such a procedure on-board of a plating tool and may in some instances be relegated to off-board implementation. The present technology may also implement a clean specifically targeting the removal of the organic deposits. The removal of the organic matrix may be accompanied by the removal of metals and metal ions within the matrix. While an acidic clean may be effective at denuding the surface of the organic deposit of metals, the bulk matrix may still incorporate metals which may form a foundation for ready replenishment of contaminating species on the next pass through the plating bath. Removal of the organics, accompanied by the removal of included metals, may revert the polymer material back to an original state, which may be smooth and metal free, and may eliminate or extend the time for initiation of plate-up for numerous additional cycles. Periodic cleaning of the seal surface to remove organics may therefore be a preferred method for preventing plate-up.

A variety of organic solvents may remove organic build-up from seals. Some of the chemicals which have been used successfully include: toluene, acetone, di-methyl sulfoxide (DMSO), N-methyl 2-pyrrolidone (NMP), methyl sulfonic acid (MSA), as well as commercial photoresist removal chemistries such as EKC 265, Techic NF-52, and Shipley BPR. Such commercial strippers may be blends of organic solvents which may include NMP, DMSO, tetra-methyl ammonium hydroxide (TMAH), ethylene glycol (EG), or other such solvents. In virtually all cases, the efficacy of the solvent may be improved when accompanied by some degree of mechanical force to effectively remove thick organic deposits from seal surfaces, which may be deposited after many hundreds of plating cycles and may be over a hundred microns thick. However, where such deposits are from a few tens of cycles, such mechanical force may be optional and the solvating capability of the solvent alone may effectively remove the deposits and maintain the relatively clean state of the seal, although continued intervals of cleaning may be performed to maintain the clean surface.

Accordingly, processes as previously described utilizing a cleaning pad and cleaning apparatus of embodiments of the present technology may further include application of any of the above-listed materials as a cleaning fluid at intermittent intervals between plating or rinsing operations. The materials may be applied from the cleaning assembly previously described, which may apply the fluid and mechanically swab the seal simultaneously, or may be applied from a separate fluid nozzle. When applied separately, a wipe down may be performed with a cleaning pad on a cleaning head described above or with another mechanical applicator, as well as by the application of sonic energy. An additional arm may be attached to the frame or to a separate module at which the chemical rinse may be performed. Heating of either the solvent or the seal may also be performed during cleaning operations, and the heating may occur with the chemical baths or by the application of heat, such as from IR lamps. By utilizing cleaning fluids discussed, either alone or by application with assemblies described throughout the present disclosure, improved cleaning may be performed to improve life and quality of seals used to support substrates during electroplating or other processing operations.

In the preceding description, for the purposes of explanation, numerous details have been set forth in order to provide an understanding of various embodiments of the present technology. It will be apparent to one skilled in the art, however, that certain embodiments may be practiced without some of these details, or with additional details. For example, other substrates that may benefit from the wetting techniques described may also be used with the present technology.

Having disclosed several embodiments, it will be recognized by those of skill in the art that various modifications, alternative constructions, and equivalents may be used without departing from the spirit of the embodiments. Additionally, a number of well-known processes and elements have not been described in order to avoid unnecessarily obscuring the present technology. Accordingly, the above description should not be taken as limiting the scope of the technology.

Where a range of values is provided, it is understood that each intervening value, to the smallest fraction of the unit of the lower limit, unless the context clearly dictates otherwise, between the upper and lower limits of that range is also specifically disclosed. Any narrower range between any stated values or unstated intervening values in a stated range and any other stated or intervening value in that stated range is encompassed. The upper and lower limits of those smaller ranges may independently be included or excluded in the range, and each range where either, neither, or both limits are included in the smaller ranges is also encompassed within the technology, subject to any specifically excluded limit in the stated range. Where the stated range includes one or both of the limits, ranges excluding either or both of those included limits are also included. Where multiple values are provided in a list, any range encompassing or based on any of those values is similarly specifically disclosed.

As used herein and in the appended claims, the singular forms "a", "an", and "the" include plural references unless the context clearly dictates otherwise. Thus, for example, reference to "a material" includes a plurality of such materials, and reference to "the channel" includes reference to one or more channels and equivalents thereof known to those skilled in the art, and so forth.

Also, the words "comprise(s)", "comprising", "contain(s)", "containing", "include(s)", and "including", when used in this specification and in the following claims, are intended to specify the presence of stated features, integers, components, or operations, but they do not preclude the presence or addition of one or more other features, integers, components, operations, acts, or groups.

What is claimed is:

1. An electroplating apparatus seal cleaning assembly comprising:

an arm pivotable between a first position and a second position, wherein the arm is rotatable about a central axis of the arm; and a cleaning head coupled with a distal portion of the arm, the cleaning head comprising:

a bracket comprising:

a faceplate coupled with the arm, and a housing extending from the faceplate, the housing defining a one or more arcuate channels extending through the housing to a front surface of the bracket, and a rotatable cartridge extending from the housing of the bracket, the cartridge including a mount cylinder defining one or more apertures configured to deliver a cleaning solution to a pad coupled about the mount cylinder.

2. The electroplating apparatus seal cleaning assembly of claim 1, wherein the cartridge defines a first inlet port accessing a first internal annular channel, wherein the cartridge defines a first access channel extending from the first internal annular channel to a distal portion of the cartridge proximate the mount cylinder.

3. The electroplating apparatus seal cleaning assembly of claim 2, wherein the first access channel extends to a second internal annular channel defined within the cartridge proximate the mount cylinder.

4. The electroplating apparatus seal cleaning assembly of claim 2, wherein the cartridge defines one or more first access channels radially distributed about a central axis of the cartridge.

5. The electroplating apparatus seal cleaning assembly of claim 1, wherein the cartridge defines a second inlet port accessing a central channel defined within the cartridge along a central axis of the cartridge.

6. The electroplating apparatus seal cleaning assembly of claim 5, wherein the cartridge defines a second access channel extending from a distal end of the central channel to a receiving port defined proximate a distal end of the cartridge.

7. The electroplating apparatus seal cleaning assembly of claim 6, wherein the cartridge defines one or more second access channels radially distributed about the central axis of the cartridge, and extending at an angle from the central axis towards a position adjacent an end of the mount cylinder.

8. The electroplating apparatus seal cleaning assembly of claim 1, wherein the cartridge extends from the bracket at an angle between about −10° and about 40°.

9. The electroplating apparatus seal cleaning assembly of claim 1, further comprising a bracket clamp coupled with the housing normal to the front surface of the bracket and configured to secure fluid lines disposed within the one or more arcuate channels.

10. The electroplating apparatus seal cleaning assembly of claim 1, wherein the mount cylinder extends about and is concentrically aligned with one or more components of the cartridge, wherein the cartridge further comprises the pad positioned about the mount cylinder, the pad extending over a first end of the mount cylinder and a second end of the mount cylinder opposite the first end, and wherein the pad is secured between the mount cylinder and the one or more components of the cartridge.

11. The electroplating apparatus seal cleaning assembly of claim 10, wherein the pad comprises a multi-layer fabric including an interior fabric and an exterior fabric.

12. The electroplating apparatus seal cleaning assembly of claim 11, wherein the interior fabric comprises a knitted polyester material.

13. The electroplating apparatus seal cleaning assembly of claim 11, wherein the exterior fabric comprises an ultra-high-molecular-weight polyethylene material.

14. The electroplating apparatus seal cleaning assembly of claim 1, wherein the cartridge defines a third inlet port configured to receive a retaining member, and wherein, when the retaining member is disengaged, the cartridge is configured to rotate about a central axis and adjust an exposed region of the pad.

* * * * *